US011031709B2

(12) United States Patent
Horii

(10) Patent No.: US 11,031,709 B2
(45) Date of Patent: Jun. 8, 2021

(54) ELECTRICAL CONNECTOR FOR CIRCUIT BOARDS AND MOUNTING ARRANGEMENT FOR ELECTRICAL CONNECTOR FOR CIRCUIT BOARDS

(71) Applicant: Hirose Electric Co., Ltd., Kanagawa (JP)

(72) Inventor: Takao Horii, Tokyo (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 16/567,973

(22) Filed: Sep. 11, 2019

(65) Prior Publication Data

US 2020/0091635 A1 Mar. 19, 2020

(30) Foreign Application Priority Data

Sep. 14, 2018 (JP) ..... JP2018-172303

(51) Int. Cl.
*H01R 13/40* (2006.01)
*H01R 12/70* (2011.01)
(Continued)

(52) U.S. Cl.
CPC ..... *H01R 12/707* (2013.01); *H01R 12/57* (2013.01); *H01R 12/716* (2013.01);
(Continued)

(58) Field of Classification Search
CPC .. H01R 12/707; H01R 12/724; H01R 12/716; H01R 13/648; H01R 13/40; H01R 12/57;
(Continued)

(56) References Cited

U.S. PATENT DOCUMENTS

2004/0235324 A1* 11/2004 Kimura ..... H01R 23/6873 439/108
2009/0190318 A1* 7/2009 Komatsu ..... H01R 12/707 361/760
(Continued)

FOREIGN PATENT DOCUMENTS

JP 2014-157790 A 8/2014

*Primary Examiner* — Truc T Nguyen
(74) *Attorney, Agent, or Firm* — Procopio, Cory, Hargreaves & Savitch LLP

(57) ABSTRACT

A housing of an electrically insulating material, signal terminals and non-signal terminals used as at least one of ground terminals and power supply terminals which are made of a metallic material and retained within the housing, and reinforcing fittings attached to the housing, wherein the non-signal terminals are located outside the array range of the signal terminals, the reinforcing fittings are located adjacent to the non-signal terminals, the non-signal terminals have connecting legs for connection to a circuit board, the reinforcing fittings have attachment legs for attachment to the circuit board P, and the connecting legs of the non-signal terminals and the attachment legs of the reinforcing fittings are located adjacent to each other in the array direction of the signal terminals within a single through-hole provided in a common land formed on the circuit board and can be solder-connected to said land.

4 Claims, 5 Drawing Sheets

(51) Int. Cl.

| | |
|---|---|
| ***H01R 12/72*** | (2011.01) |
| ***H01R 12/71*** | (2011.01) |
| ***H01R 13/648*** | (2006.01) |
| ***H01R 12/57*** | (2011.01) |
| ***H01R 13/6471*** | (2011.01) |
| ***H01R 43/02*** | (2006.01) |

(52) U.S. Cl.
CPC ..... *H01R 12/724* (2013.01); *H01R 13/40* (2013.01); *H01R 13/648* (2013.01); *H01R 13/6471* (2013.01); *H01R 43/0256* (2013.01)

(58) Field of Classification Search
CPC ..... H01R 13/6471; H01R 43/0256; H01R 12/727; H01R 12/58
See application file for complete search history.

(56) References Cited

U.S. PATENT DOCUMENTS

| | | | | |
|---|---|---|---|---|
| 2009/0209119 | A1* | 8/2009 | Tanaka | H01R 13/4223 439/78 |
| 2014/0377969 | A1* | 12/2014 | Cheng | H01R 13/6581 439/83 |
| 2017/0338602 | A1* | 11/2017 | Ho | H01R 24/60 |
| 2018/0183186 | A1* | 6/2018 | Yu | H01R 13/40 |

* cited by examiner

ELECTRICAL CONNECTOR FOR CIRCUIT BOARDS AND MOUNTING ARRANGEMENT FOR ELECTRICAL CONNECTOR FOR CIRCUIT BOARDS

CROSS-REFERENCE TO RELATED APPLICATIONS

This application claims priority to Japanese Patent Application No. 2018-172303, filed Sep. 14, 2018, the contents of which are incorporated herein by reference in its entirety for all purposes.

TECHNICAL FIELD

The present invention relates to an electrical connector for circuit boards mounted to a circuit board and a mounting arrangement for an electrical connector for circuit boards.

RELATED ART

Known connectors of this type include the connector disclosed in Patent Document 1. The connector disclosed in Patent Document 1 is a so-called right-angle connector in which, upon mounting to a circuit board, a direction parallel to a mounting face of the circuit board is used as the direction of plugging and unplugging of a counterpart connector. In this connector, the terminals include lower terminals that have their contact portions, which are used for contacting the counterpart connector, oriented in the above-mentioned direction of plugging and unplugging, and that have their contact portions located at a lower level closer to the mounting face, and upper terminals at an upper level, which are located thereabove, with both the lower and the upper terminals bent at right angles at intermediate locations and their lower end sections used as connecting portions mounted to the circuit board. The connecting portions of the lower terminals are passed through terminal through-holes in the circuit board and, after installation through the terminal through-holes, are solder-connected to lands formed on the perimeter edge of the terminal through-holes; the upper terminals have their connecting portions bent into surface contact with the lands on the surface of the circuit board and solder-connected to said lands while in surface contact therewith.

In the connector of Patent Document 1, the housing that retains the terminals is surrounded by and retained in a case-like shell, with each of the multiple attachment legs of said shell installed through a corresponding shell through-hole in the circuit board, and, in the same manner as in the case of the lower terminals, upon installation through a shell through-hole, said attachment legs are solder-connected to a land formed on the surface of the circuit board on the perimeter edge of said shell through-hole. Electrically, the shell functions as a shielding case, and mechanically as a reinforcing fitting.

Therefore, in the connector of Patent Document 1, the strength of attachment of the connector to the mounting face is improved because each connecting portion of the lower terminals is solder-connected to a land on the perimeter edge of a terminal through-hole and the attachment legs of the shell are solder-connected to the lands on the perimeter edge of the shell through-holes.

PATENT DOCUMENTS

[Patent Document 1]

Japanese Patent Application Publication No. 2014-157790.

SUMMARY

Problems to be Solved

However, in the connector of Patent Document 1, the attachment legs of the shell are installed through shell through-holes disposed in a spaced-apart relationship to the rows of the terminal through-holes of the above-mentioned lower terminals in the array direction of said terminal through-holes as well as in a direction perpendicular to said array direction, and are solder-connected to the lands on their perimeter edge.

The above-mentioned shell through-holes are disposed and formed in alignment with the locations of the respective attachment legs of the shell, on both sides outside the array range of the above-mentioned terminal through-holes, at locations spaced away from the terminal through-holes in a direction perpendicular to the array direction. In other words, the attachment legs of the above-mentioned shell must be provided at locations spaced away from said terminal through-holes both in the array direction of the lower terminals and in a direction perpendicular thereto. Forming multiple lands at mutually spaced locations on the circuit board increases the extent of the area necessary on the circuit board for multiple land formation, which includes land-free zones between the lands, and increases the size of both the connector and devices using said connector.

In addition to signal terminals, the terminals of this type of connector include power supply terminals. The power supply terminals, which supply electrical power used for signal control in the signal terminals, are larger in size than the signal terminals because they use electric currents that are stronger than those of the signal terminals. Therefore, when the connecting portions of such power supply terminals are installed through terminal through-holes other than the through-holes used for the signal terminals and are solder-connected to lands on the perimeter edge of the through-holes, the through-holes and lands become larger than the through-holes and lands used for the signal terminals commensurately with the increase in the dimensions of the power supply terminals. Furthermore, when, in addition to these power supply terminals, the attachment legs of the above-mentioned shell or attachment legs forming part of reinforcing fittings used in the connector are disposed at locations spaced away from the terminals as described in Patent Document 1, the increase in connector size becomes even more significant.

With these circumstances in mind, it is an object of the present invention to provide an electrical connector for circuit boards and a mounting arrangement for said electrical connector for circuit boards in which the connector has reinforcing fittings and, even if the attachment legs of the reinforcing fittings are solder-connected to a land on a circuit board, an increase in the size of the connector can be avoided without increasing the extent of the area necessary for land formation on the circuit board that is required for land placement.

Technical Solution

It is an object of the invention to provide an electrical connector for circuit boards and a mounting arrangement therefore in which the extent of the area necessary for land formation on the circuit board is minimized.

The inventive electrical connector for circuit boards, which is provided with a housing of an electrically insulating material, signal terminals and non-signal terminals serving as at least one of ground terminals and power supply terminals made of a metallic material and retained within said housing, and reinforcing fittings attached to the housing, is mounted to a circuit board.

In the present invention, such an electrical connector for circuit boards is characterized in that the non-signal terminals are located outside the array range of the signal terminals, the reinforcing fittings are located adjacent to said non-signal terminals, the non-signal terminals have connecting legs for connection to the circuit board, the reinforcing fittings have attachment legs for attachment to the circuit board, and the connecting legs of the non-signal terminals and the attachment legs of the reinforcing fittings are located adjacent to each other in the above-mentioned array direction within a single through-hole provided in a common land formed on the circuit board and can be solder-connected to said land.

In accordance with the thus-configured present invention, the connecting legs of the non-signal terminals and the attachment legs of the reinforcing fittings are solder-connected to a single common land within a single common through-hole. For this reason, there are no longer any land-free zones between the above-mentioned connecting legs and attachment legs in the area necessary for land formation. As a result, the extent of the area required for land formation is minimized both in the above-mentioned array direction and in a direction perpendicular to said array direction, and the connector is made more compact. In addition, as a result of being located within a single common through-hole, the above-mentioned connecting legs and attachment legs are solder-connected to a single common land in close proximity to one another and the solder strength of the connecting legs and attachment legs is improved.

In the present invention, the housing can be adapted such that the receiving portion used for plugging and unplugging a counterpart connector is formed with its opening oriented such that the direction of plugging and unplugging of said counterpart connector is parallel to the mounting face of the circuit board. In this type of connector, even if the force used when plugging and unplugging a counterpart connector that operates in a direction perpendicular to the direction in which the connecting legs and attachment legs extend acts as a shearing force or a bending moment on the attachment legs and connecting portions that have been solder-connected in close proximity in a manner that imparts improved strength, the above-mentioned connecting portions and attachment legs will be able to adequately counteract it.

In the present invention, the non-signal terminals and the reinforcing fittings are made of sheet metal and can be adapted such that at least the through-thickness direction of the attachment legs of the reinforcing fittings intersects the direction of plugging and unplugging of the counterpart connector. In accordance with this embodiment, the attachment legs of the reinforcing fittings are typically of larger dimensions than the connecting portions of the non-signal terminals and, therefore, have higher strength. In addition, the above-mentioned force used when unplugging a counterpart connector can be adequately counteracted because the through-thickness direction of the attachment legs is oriented such as to intersect the direction of plugging and unplugging of the counterpart connector.

When this inventive electrical connector for circuit boards is disposed on a circuit board, the attachment legs of the reinforcing fittings and the connecting portions of the non-signal terminals of said electrical connector for circuit boards are located within a single through-hole in the circuit board and are solder-connected to a land on the perimeter edge of the through-hole, thereby forming a mounting arrangement of the electrical connector for circuit boards in conjunction with the circuit board.

Technical Effect

According to the present invention as described above, in a connector having reinforcing fittings in addition to signal terminals and non-signal terminals, the connecting legs of the non-signal terminals and the attachment legs of the reinforcing fittings are adjacent to each other in the array direction of the signal terminals within a single common through-hole located in a single common land formed on a circuit board and are solder-connected to said land, as a consequence of which, due to the fact that the connecting legs of the non-signal terminals and the attachment legs of the reinforcing fittings are located within a single through-hole and said through-hole is located in the array direction of the signal terminals outside the array range of the signal terminals, no land-free zones are present within the area necessary for the formation of the land formed across the surface of the circuit board on the perimeter edge of the through-hole between the connecting portions of the above-mentioned non-signal terminals and the attachment legs of the reinforcing fittings, as a result of which the area may be smaller both in the above-mentioned array direction and in a direction perpendicular to the array direction, and the connector is made more compact; and, furthermore, solder-connecting the connecting portions of the above-mentioned non-signal terminals and the attachment legs of the reinforcing fittings to the single common through-hole in close proximity to one another provides the benefit of obtaining an electrical connector for circuit boards and a mounting arrangement for an electrical connector for circuit boards possessing increased attachment strength and capable of adequately counteracting external forces, more particularly, forces exerted when plugging and unplugging a counterpart connector.

DETAILED DESCRIPTION

Figure 1:
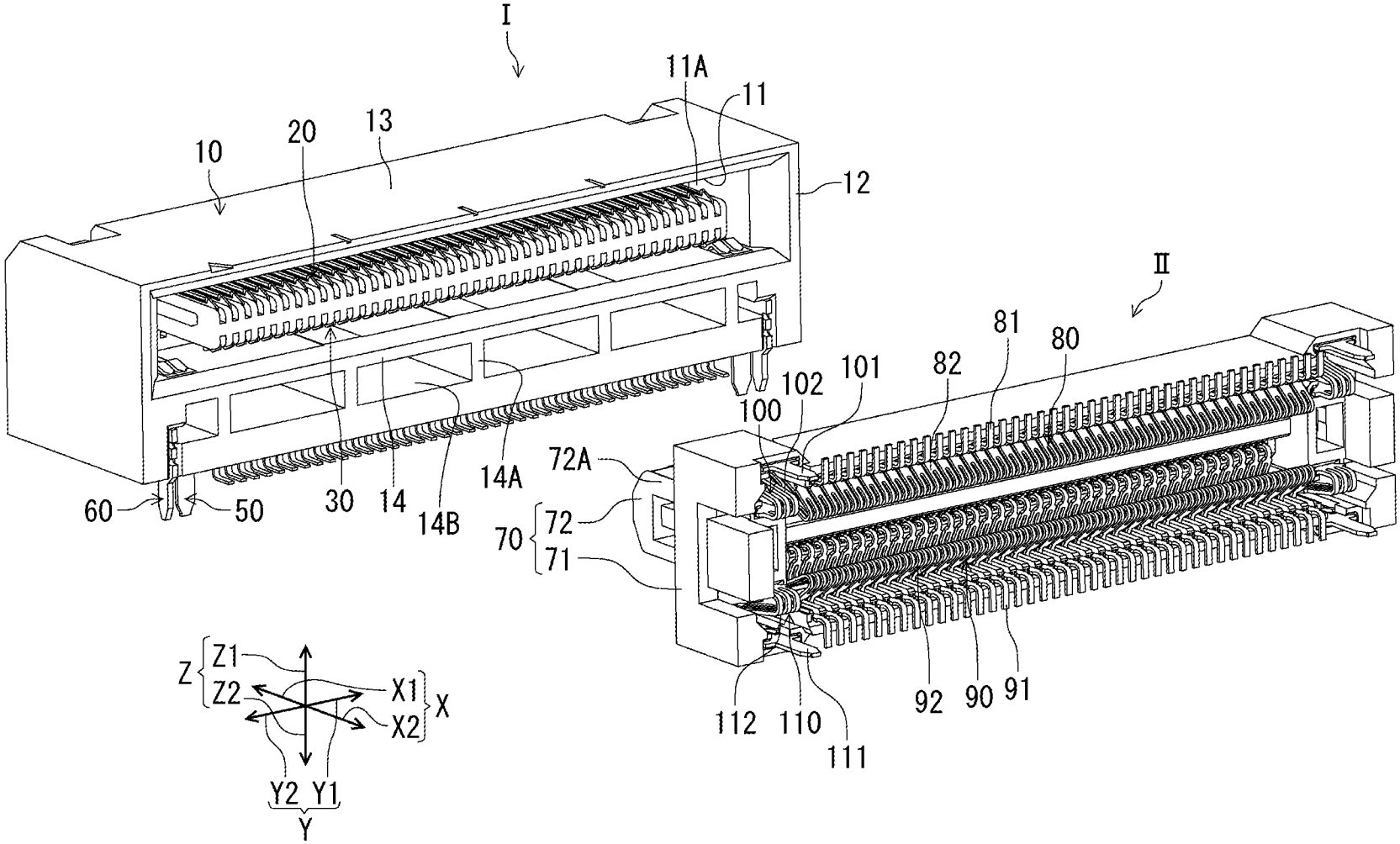
FIG. 1 illustrates a perspective view illustrating a first connector and a counterpart second connector in a state that immediately precedes mating in an embodiment of the present invention.

FIG. 1 is a perspective view illustrating a first connector I and a counterpart second connector II to be mated thereto in a state that immediately precedes mating in an embodiment of the present invention. In FIG. 1 and subsequent figures, spatial coordinates X, Y, Z are configured for the two connectors I and II for ease of understanding of directions. X is the direction of plugging and unplugging of the two connectors I, II, where the forward direction from the second connector II to the first connector I is designated as X1 and the opposite rearward direction is designated as X2; Y is the terminal array direction of the two connectors I, II, where one direction is designated as Y1 and the opposite direction as Y2; and Z is the height direction of the connector, where the upward direction is designated as Z1, and the downward direction is designated as Z2.

The above-mentioned first connector I, wherein its bottom face (surface located at the lower Z2 end) is mounted to a circuit board (not shown) and the attachment legs of the reinforcing fittings and the connecting legs of the hereinafter-described power supply terminals that protrude downward along the Z2-axis are disposed through a through-hole in the circuit board and solder-connected to said circuit board, is a so-called right-angle connector in which a direction perpendicular to the connecting legs and attachment legs, i.e., a direction parallel to the mounting face of the circuit board, is used as the direction of plugging and unplugging X of a counterpart second connector II, and the second connector II is formed such as to be mated with, and extracted from, the first connector I in said direction of plugging and unplugging X. The first connector I, the second connector II, the circuit board to which the first connector I is mounted, and, furthermore, the mounting of the first connector I to the circuit board will be described below.

<First Connector I>

The first connector I has a housing 10 of a substantially rectangular parallelepiped-like external configuration made of an electrically insulating material, as well as upper signal terminals 20 and lower signal terminals 30, which are retained in place in said housing 10 at predetermined intervals in the terminal array direction Y, i.e., in the connector width direction, and which have contact portions disposed in two upper and lower rows in the height direction Z of the connector; upper power supply terminals 40 and lower power supply terminals 50, which are retained within the housing 10 at locations outside the array range of the above-mentioned upper signal terminals 20 and lower signal terminals 30 in the terminal array direction Y; and, furthermore, reinforcing fittings 60, which are retained within the housing 10 at outer locations thereof.

As can be seen in FIG. 1, in the first connector I, the multiple upper signal terminals 20 and lower signal terminals 30 are arranged in the terminal array direction Y within the housing 10, the upper power supply terminals 40 (not shown in FIG. 1) and lower power supply terminals 50 are located in the same direction outside their array range, and, furthermore, the reinforcing fittings 60 are located at outer locations thereof.

Figure 2:
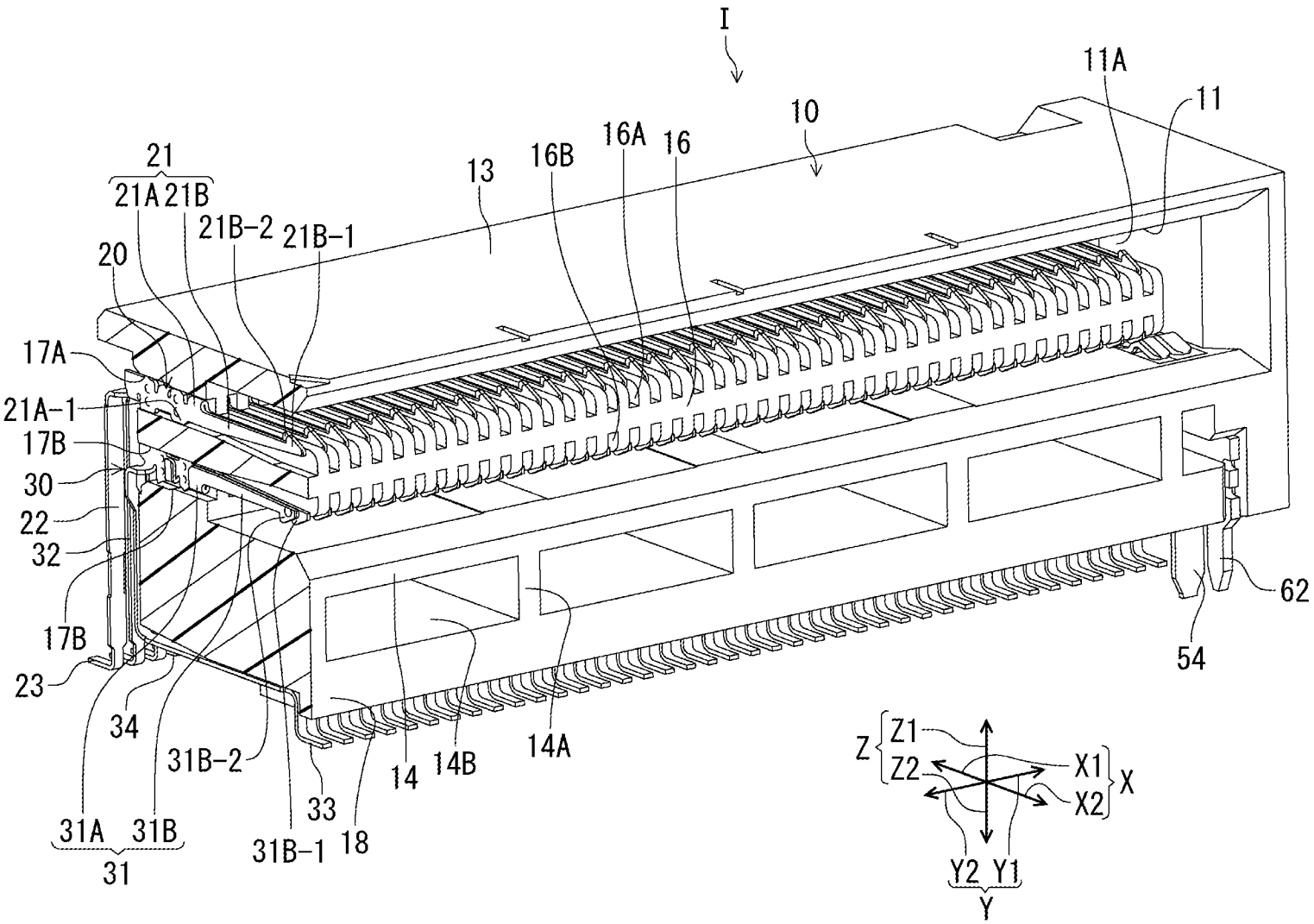
FIG. 2 illustrates a Z-X plane cross-section view of the first connector shown in FIG. 1 taken across the upper signal terminals and lower signal terminals at the same location in the terminal array direction.
Figure 3:
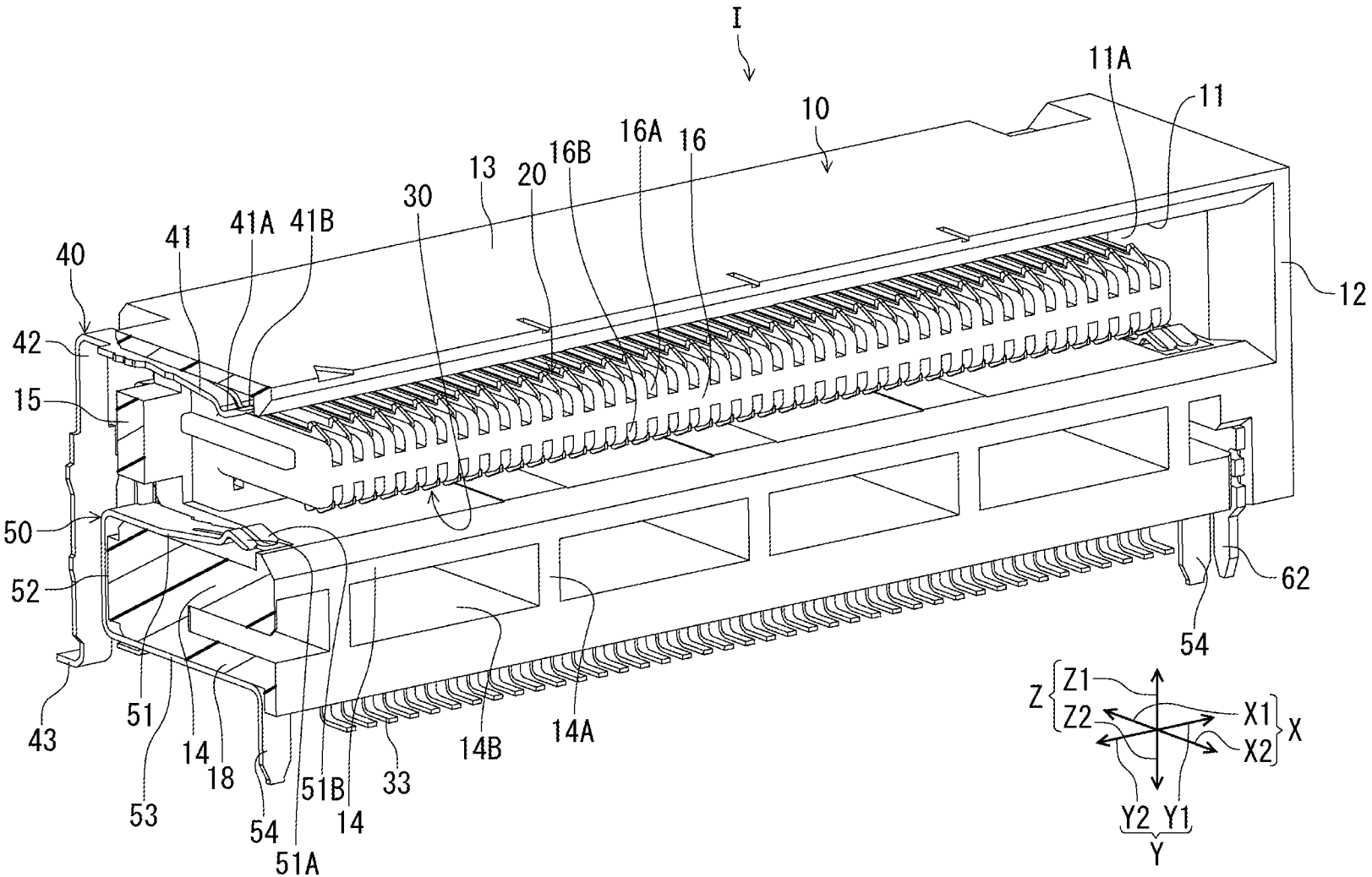
FIG. 3 illustrates a Z-X plane cross-section view of the first connector shown in FIG. 1 taken across the upper power supply terminals and lower power supply terminals at the same location in the terminal array direction.
Figure 4:
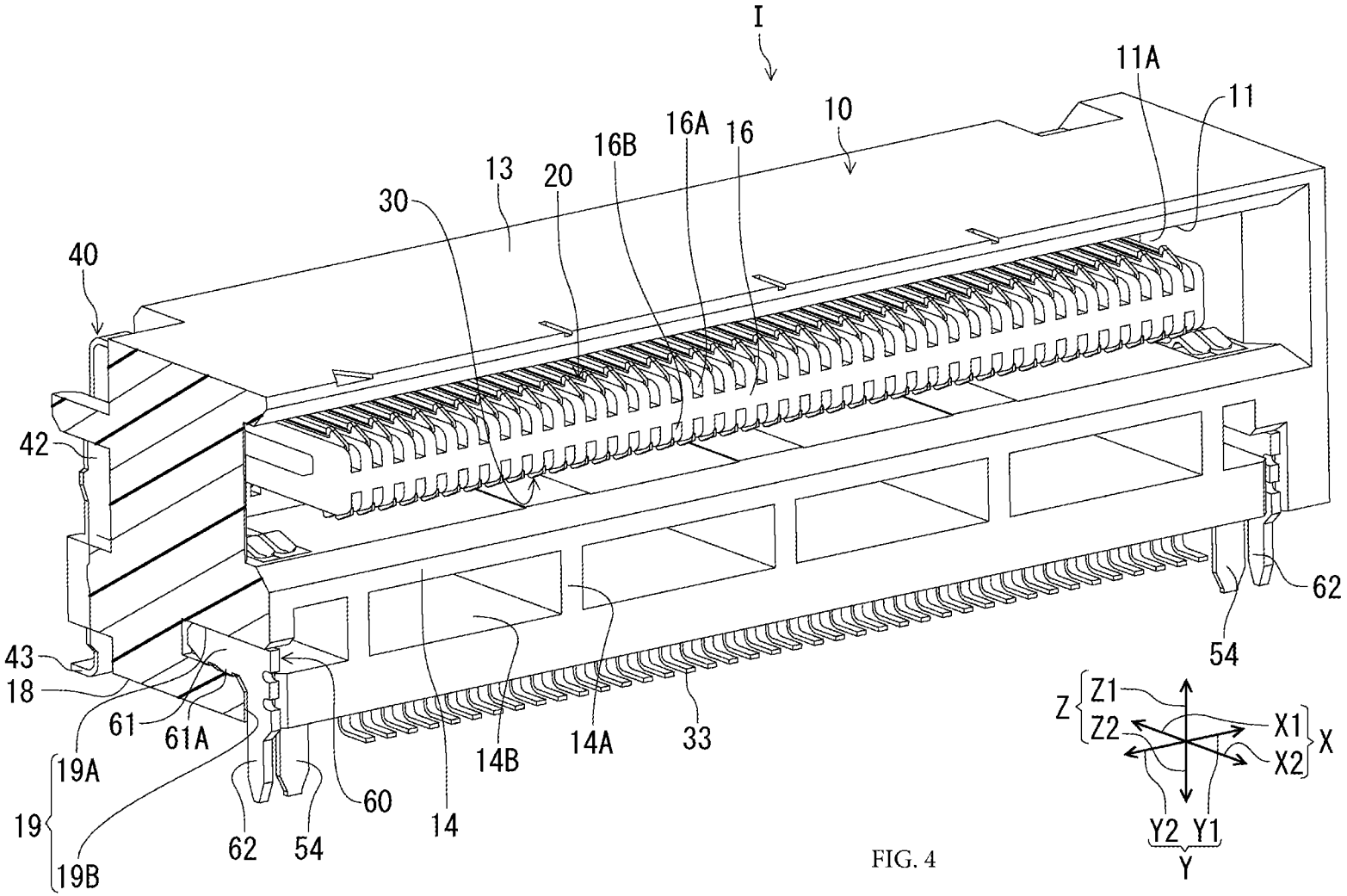
FIG. 4 illustrates a Z-X cross-section view of the first connector shown in FIG. 1 taken at the location of a reinforcing fitting in the terminal array direction.

FIG. 2 shows a Z-X plane cross-section of the connector I taken at the location of an arbitrary pair comprising an upper signal terminal 20 and a lower signal terminal 30 in the terminal array direction Y, FIG. 3 shows a Z-X plane cross-section of the connector I taken at the location of an upper power supply terminal 40 and a lower power supply terminal 50, and FIG. 4 shows a Z-X plane cross-section of the connector I at the location of a reinforcing fitting 60.

As can be seen in FIGS. 1 to 4, the housing 10 has a receiving portion 11 that is open at the rear along the X2-axis, i.e., in the direction of extraction of the second connector II, in the top half of the housing 10, and recesses 14B, which are constituted by "cavities" intended to provide ribs 14A with a view to improving the strength of the housing 10 and preventing the warping of said housing 10, are formed in the bottom half of said housing 10.

The elongated receiving portion 11 extends between two lateral walls 12 located at both ends in the terminal array direction Y, and, in the height direction Z of the connector, this portion is formed between a top wall 13 and a partition 14 provided at an intermediate location in the height direction Z of the connector. A plate-shaped terminal array protrusion 16, which extends to the rear along the X2-axis from a front end wall 15 of the housing 10 located at the front end in the X1 direction, is provided within said receiving portion 11, and an annular receiving space 11A, which receives the mating protrusion of the hereinafter-described second connector II, is formed within the above-mentioned receiving portion 11 around the periphery of the terminal array protrusion 16. Terminal array grooves 16A, 16B, which are formed on the top and bottom faces of the above-mentioned terminal array protrusion 16, extend in the direction of plugging and unplugging X at predetermined intervals in the terminal array direction Y. The terminal array grooves 16A, 16B are respectively in communication with terminal press-fit holes 17A, 17B formed by passing through the above-mentioned front end wall 15 of the housing 10.

The terminals of the first connector I comprise upper signal terminals 20, lower signal terminals 30, upper power supply terminals 40, and lower power supply terminals 50. If necessary, the first connector I can be selectively provided with a shielding plate, in which case the ground terminals of the shielding plate, the upper power supply terminals 40, and the lower power supply terminals 50 are collectively referred to as non-signal terminals in contradistinction to the upper signal terminals 20 and lower signal terminals 30.

As can be seen in FIG. 2, multiple upper signal terminals 20 and lower signal terminals 30, which are fabricated by molding and bending strip-shaped members of sheet metal, are respectively arranged in the terminal array direction Y.

The upper signal terminals 20 have contact arm portions 21, which extend in the direction of plugging and unplugging X, leg portions 22, which extend from the ends of the base portions 21A of said contact arm portions 21 outside of the housing 10 downward along the Z2-axis in the height direction Z of the connector, and connecting portions 23, which are obtained by bending said leg portions 22 at the lower ends such as to make them parallel to the mounting face of the circuit board and bring them into surface contact with said circuit board. Said connecting portions 23 are arranged along the lower forward edge of the bottom wall 18 of the housing 10.

The contact arm portions 21 are formed by folding over the strip-shaped members of sheet metal constituting the upper signal terminals 20 upon itself, and their through-thickness direction is the terminal array direction Y. Said contact arm portions 21 have base portions 21A, which are press-fitted rearwardly along the X2-axis into the terminal press-fit holes 17A formed in the front end wall 15 of the housing 10, and resilient arm portions 21B, which extend from said base portions 21A to the rear along the X2-axis within the above-mentioned terminal array grooves 16A on the top face of the terminal array protrusion 16. Engagement projections 21A-1, which prevent extraction by biting into the wall surface of the terminal press-fit holes 17A, are provided in the top base portions 21A. Upward-protruding contact portions 21B-1, 21B-2 are provided at locations slightly offset with respect to each other in the direction of plugging and unplugging X at the distal ends (rear ends in the X2 direction) of the above-mentioned resilient arm portions 21B. The two contact portions 21B-1, 21B-2 are formed, respectively, on one side and the other side obtained by folding over the contact arm portions 21 upon itself as discussed before.

The lower signal terminals 30 have contact arm portions 31, which extend in the direction of plugging and unplugging X; leg portions 32, which extend from the ends of the base portions 31A of said contact arm portions 31 outside of the housing 10 downward along the Z2-axis in the height direction Z of the connector; transverse portions 34, which are obtained by bending said leg portions 32 at the lower ends to extend along the bottom face of the housing 10 to the rear along the X2-axis; and connecting portions 33, which are obtained by bending the rear ends of said transverse portions 34 downward along the Z2-axis and then bending such as to make them parallel to the mounting face of the circuit board and bring them into surface contact with said circuit board. Said connecting portions 33 are arranged along the lower rear edge of the bottom wall 18 of the housing 10. In such lower signal terminals 30, the contact arm portions 31, leg portions 32, and transverse portions 34 create a lateral U-shaped configuration open to the rear along the X2-axis, which is supported due to the fact that it straddles the housing 10. For this reason, even if the lower signal terminals 30 are subject to a friction force generated by counterpart terminals and acting rearward along the X2-axis during rearward extraction of the counterpart second connector II in the X2 direction, deformation during extraction is avoided because of the support provided by the housing 10.

The contact arm portions 31 are formed by folding over the strip-shaped members of sheet metal constituting the lower signal terminals 30 upon itself, and their through-thickness direction is the terminal array direction Y. Said contact arm portions 31 have base portions 31A, which are press-fitted rearward along the X2-axis into the terminal press-fit holes 17B formed in the front end wall 15 of the housing 10, and resilient arm portions 31B, which extend from said base portions 31A rearward along the X2-axis within the above-mentioned terminal array grooves 16B on the bottom face of the terminal array protrusion 16. Engagement projections (not shown in FIG. 2), which prevent extraction by biting into the wall surface of the terminal press-fit holes 17B, are provided in the top base portions 31A. Downward-protruding contact portions 31B-1, 31B-2 are provided at locations slightly offset with respect to each other in the direction of plugging and unplugging X at the distal ends (rear ends in the X2 direction) of the above-mentioned resilient arm portions 31B. These two contact portions 31B-1, 31B-2 are formed, respectively, on one side and the other side obtained by folding over the contact arm portions 31 upon itself as discussed before.

Now, as can be seen in FIG. 3, the power supply terminals, which are non-signal terminals comprised of the upper power supply terminals 40 and the lower power supply terminals 50, are provided in the terminal array direction Y on the outside of the array range on both sides of the above-mentioned upper signal terminals 20 and lower signal terminals 30. The upper power supply terminals 40 and lower power supply terminals 50 are formed by bending strip-shaped members of sheet metal in the through-thickness direction thereof, and their width (terminal width) in the terminal array direction Y across their major faces perpendicular to the through-thickness direction is wider than the terminal width of the upper signal terminals 20 and lower signal terminals 30.

The above-mentioned upper power supply terminals 40 have a contact arm portion 41, which extends rearward along the X2-axis in the direction of plugging and unplugging X along the bottom face of the upper wall 13 of the housing 10, a front leg portion 42, which is obtained by bending the front end of said contact arm portion 41 and extends downward along the Z2-axis along the front surface of the front end wall 15 of the housing 10, and a connecting portion 43, which is obtained by bending the lower end of said front leg portion 42 at the forward edge of the above-mentioned bottom wall 18 and extends forward along the X1-axis, with said connecting portion 43 solder-connected to the circuit board in surface contact therewith.

The distal end of the above-mentioned contact arm portion 41, which is oriented rearward along the X2-axis, is bifurcated into two branches and, at the same time, the branch portions are bent downward along the Z2-axis in a V-shape and have two contact portions 41A, 41B in a side-by-side arrangement. The contact arm portion 41 possesses resilience that results in flexure in the height direction Z of the connector, and when the above-mentioned contact portions 41A, 41B are in contact with the corresponding power supply terminals of the counterpart second connector II, the resilient flexure generates contact pressure against the corresponding power supply terminals.

The above-mentioned lower power supply terminals 50 have a contact arm portion 51, which is located along the top face of the partition 14 of the housing 10 and extends to the rear along the X2-axis in the direction of plugging and unplugging X, a front leg portion 52, which is obtained by bending the front end of said contact arm portion 51 and extends downward along the Z2-axis along the front surface of the front end wall 15, a bottom arm portion 53, which extends to the rear along the X2-axis along the bottom face of the above-mentioned bottom wall 18 from the lower end of said front leg portion 52, and a connecting leg 54, which is obtained by bending said bottom arm portion 53 at the rear edge of the above-mentioned bottom wall 18 and extends downward along the Z2-axis. The above-mentioned contact arm portion 51, front leg portion 52, and bottom arm portion 53, which form a lateral U-shaped configuration open to the rear along the X2-axis, are mounted to the housing 10 so as to straddle the top face of the above-mentioned partition 14 of the housing 10 and the bottom face of the bottom wall 18 rearward along the X2-axis, and, since this housing 10, as described hereinafter, is firmly retained in place by the reinforcing fittings 60, the lower power supply terminals 50 are securely engaged without decoupling from the above mentioned housing 10 even when acted upon by a friction force acting rearward along the X2-axis during extraction of the counterpart second connector II.

As can be seen in FIG. 3, the above-mentioned contact arm portion 51, which is shaped to be vertically symmetrical to the contact arm portion 41 of the upper power supply terminals 40, has its distal end, which is oriented rearward along the X2-axis, bifurcated into two branches, with the branch portions bent upward along the Z1-axis in an inverted V-shape and having two contact portions 51A, 51B in a side-by-side arrangement. The contact arm portion 51 possesses resilience that results in flexure in the height direction Z of the connector, and when the above-mentioned contact portions 51A, 51B are in contact with the corresponding power supply terminals of the counterpart second connector II, the resilient flexure generates contact pressure against the corresponding power supply terminals.

The connecting legs 54 of the above-mentioned lower power supply terminals 50, which have major faces with planar surfaces in the Y-Z plane including the terminal array direction Y and the height direction Z of the connector, in other words, major faces perpendicular to the direction of plugging and unplugging X, extend downward along the Z2-axis in a configuration tapered toward the lower ends.

Now, as can be seen in FIG. 4, the reinforcing fittings 60 are fabricated by stamping out from a metal sheet of a larger thickness than that of the non-signal terminals, i.e., the upper signal terminals 20, lower signal terminals 30, upper power supply terminals 40, and lower power supply terminals 50. As shown in FIG. 4, the reinforcing fittings 60, which are shaped in an inverted L configuration, have a retained arm 61 oriented forward along the X1-axis from the rear face of the housing 10, and an attachment leg 62 extending downward along the Z2-axis from the rear end of said retained arm 61. Said attachment legs 62 are located along the same line in the terminal array direction Y as the connecting portions 33 of the lower signal terminals 30 and the connecting legs 54 of the lower power supply terminals 50 and, moreover, are adjacent to the connecting legs 54 of the lower power supply terminals 50 in the same direction. These reinforcing fittings 60 are mounted into fitting grooves 19 formed as slits of an inverted L-shaped configuration in the housing 10. Said fitting grooves 19 of the housing 10 have a retaining groove 19A, into which the above-mentioned retained arm 61 is press-fitted forward along the X1-axis, and a holding groove 19B, which holds the attachment leg 62. At its bottom edge, the retained arm 61 of the above-mentioned reinforcing fittings 60 has an engagement projection 61A that bites into the surface of the retaining groove 19A and prevents extraction of the reinforcing fittings 60. The attachment legs 62, which have major faces with planar surfaces in the Z-X plane including the direction of plugging and unplugging X and the height direction Z of the connector, in other words, major faces parallel to the direction of plugging and unplugging X, extend downward along the Z2-axis in a configuration tapered toward the lower ends.

In this manner, the attachment legs 62 of said reinforcing fittings 60 are located in a direction in which their major faces forming planar surfaces are at right angles to the connecting legs 54 of the lower power supply terminals 50 described above.

<Second Connector>

Since the second connector II to be mated to the first connector I is not material to the present invention, the discussion below will focus only on certain aspects of engagement with the first connector I.

As can be seen in FIG. 1, the second connector II is a connector that is connected to the first connector I via insertion forward along the X1-axis in the direction of plugging and unplugging X and extracted therefrom rearward along the X2-axis, with its rear face mounted to another circuit board (not shown). Therefore, the mounting face (circuit side) of the circuit board to which the first connector I is mounted and that of the other circuit board to which the above-mentioned second connector II is mounted are mutually perpendicular.

The second connector II has a housing 70 of a substantially rectangular parallelepiped-like external configuration made of an electrically insulating material, which is provided with a mating protrusion 72 mated with the annular receiving space 11A of the receiving portion 11 of the first connector I, as well as upper signal terminals 80, lower signal terminals 90, upper power supply terminals 100, and lower power supply terminals 110 made of sheet metal, which are retained in place in said housing 10.

The above-mentioned housing 70 has a housing main body portion 71, which is located rearward along the X2-axis, and a mating protrusion 72, which protrudes forwardly along the X1-axis from said housing main body portion 71. Said mating protrusion 72 has upper and lower walls located at the top and bottom in the height direction Z of the connector (not shown in the figures) and lateral walls 72A connecting the ends of the above-mentioned upper and lower walls in the terminal array direction Y, with these upper, lower, and lateral walls forming a tubular body open forward along the X1-axis. This tubular body enters the annular receiving space 11A of the second connector II and the terminal array protrusion 16 of the first connector I enters the interior space of said tubular body, thereby mating the two connectors I, II.

The above-mentioned upper signal terminals 80 and lower signal terminals 90, which are fabricated to have vertically symmetrical shapes, have contact portions (not shown in FIG. 1) located within the above-mentioned mating protrusion 72, connecting portions 81, 91 located outside of the housing 70 and solder-connected to a circuit board, and resilient portions 82, 92 of a substantially S-shaped configuration that couple the contact portions and the connecting portions 81, 91. The contact portions of the above-mentioned upper signal terminals 80 are located on the bottom face of the upper wall of the mating protrusion 72, and the contact portions of the lower signal terminals 90 are located on the top face of the lower wall. The connecting portions 81 of the above-mentioned upper signal terminals 80 and the connecting portions 91 of the lower signal terminals 90 are bent in an L-shaped configuration so as to be parallel to the mounting face of the circuit board.

The above-mentioned upper power supply terminals 100 and lower power supply terminals 110, which are fabricated to have vertically symmetrical shapes, have contact portions (not shown in FIG. 1) located within the above-mentioned mating protrusion 72, connecting portions 101, 111 located outside of the housing 70 and solder-connected to a circuit board, and resilient portions 102, 112 of a substantially S-shaped configuration that couple the contact portions and the connecting portions 101, 111. The contact portions of the above-mentioned upper power supply terminals 100 are located on the bottom face of the upper wall of the mating protrusion 72, and the contact portions of the lower power supply terminals 110 are located on the top face of the lower wall. The connecting portions 101 of the above-mentioned upper power supply terminals 100 and the connecting portions 111 of the lower power supply terminals 110 are bent in an L-shaped configuration so as to be parallel to the mounting face of the circuit board.

<Circuit Board>

Figure 5:
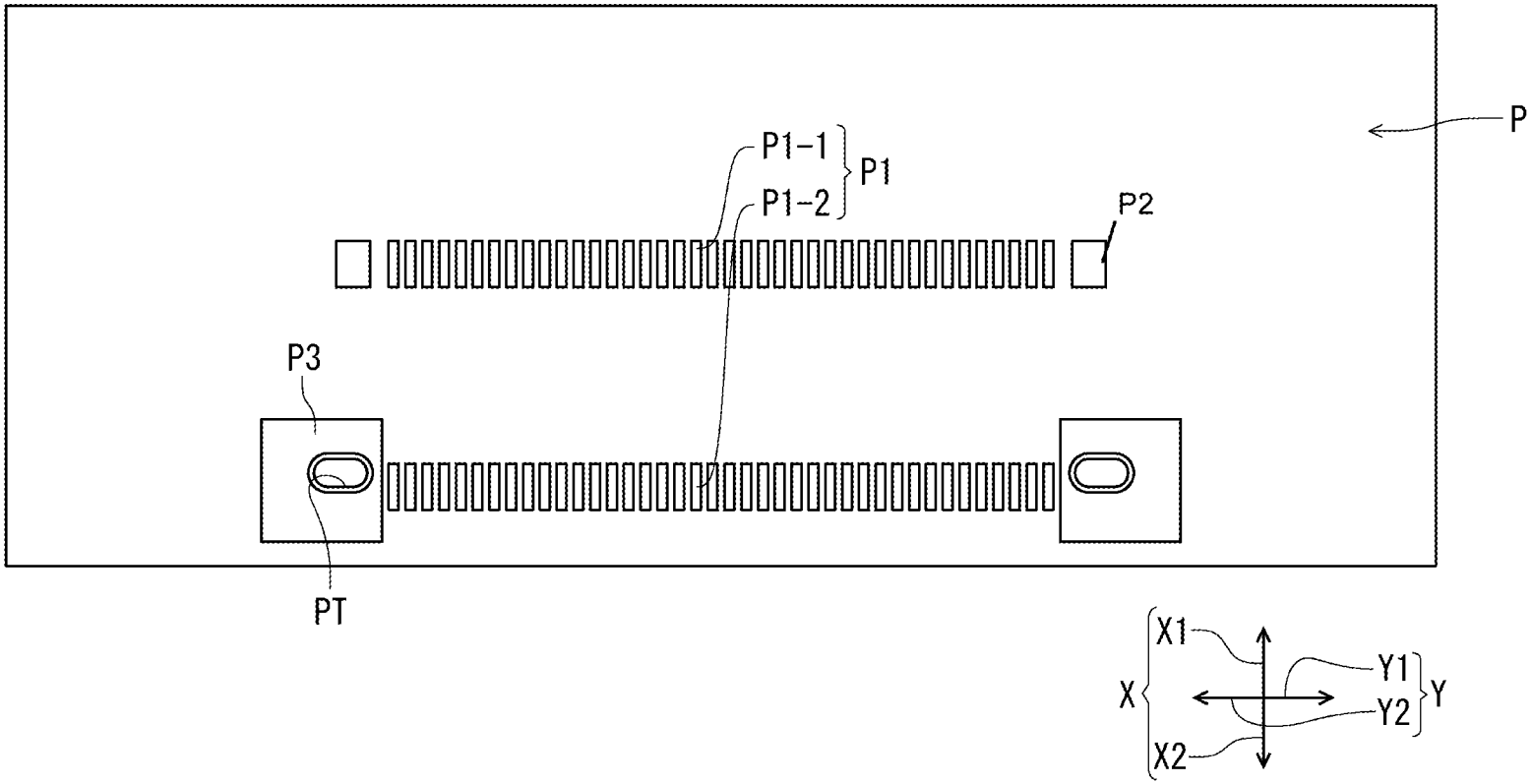
FIG. 5 illustrates a plan view of the mounting range on the circuit board, within which the first connector shown in FIG. 1 is mounted.

FIG. 5, which is a plan view of the circuit board P that has the first connector I mounted thereto, taken in the height direction Z of the connector, shows the area of the section where the first connector I is mounted. The lands used for solder-connecting the connecting portions of the signal terminals, connecting legs of the power supply terminals, and attachment legs of the reinforcing fittings are formed on the mounting face of the circuit board P. Said lands include signal terminal lands P1, power supply terminal lands P2, and common lands P3 shared by the power supply terminals and the reinforcing fittings.

The signal terminal lands P1 consist of multiple upper signal terminal lands P1-1 and multiple lower signal terminal lands P1-2 disposed in two rows. The upper signal terminal lands P1-1 are provided at locations with which the connecting portions 23 of the upper signal terminals 20 are in surface contact, and the lower signal terminal lands P1-2 are provided at locations with which the connecting portions 33 of the lower signal terminals 30 are in surface contact.

The width of the power supply terminal lands P2, which are located outside the array range of the upper signal terminal lands P1-1 at locations with which the connecting portions 43 of the upper power supply terminals 40 are in surface contact, is wider than that of the above-mentioned upper signal terminal lands P1-1.

The common lands P3, which are located outside the array range of the lower signal terminal lands P1-2 and are formed on the mounting face so as to extend around the periphery of a through-hole PT holding a connecting leg 54 of a lower power supply terminal 50 and an attachment leg 62 of a reinforcing fitting 60 adjacent thereto, are considerably wider than the power supply terminal lands P2, to which the connecting portions 43 of the above-mentioned upper power supply terminals 40 are solder-connected.

<Mounting of First Connector I to Circuit Board P>

The first connector I is mounted to the circuit board P via solder connection, thereby forming a mounting arrangement of the electrical connector for circuit boards.

Such mounting is accomplished by disposing the first connector I at a predetermined location on the circuit board P and then solder-connecting it to the circuitry. When the first connector I is disposed at a predetermined location on the circuit board P, the connecting portions 23 of the upper signal terminals 20 are respectively disposed on and solder-connected to the surface of the upper signal terminal lands P1-1, the connecting portions 33 of the lower signal terminals 30 are disposed on and solder-connected to the surface of the lower signal terminal lands P1-2 and, in addition, the connecting portions 43 of the upper power supply terminals 40 are disposed on and solder-connected to the surface of the power supply terminal lands P2. On the other hand, the connecting legs 54 of the lower power supply terminals 50 and the attachment legs 62 of the reinforcing fittings 60 are placed within a single common through-hole PT or positioned so as to pass through said through-hole PT and then solder-connected together to a common land P3 formed on the mounting face so as to extend around the periphery of said through-hole PT. Solder-attaching the connecting legs 54 of the above-mentioned lower power supply terminals 50 and the attachment legs 62 of the reinforcing fittings 60 to a common land P3 within a single common through-hole PT causes the above-mentioned connecting legs 54 and attachment legs 62 to reinforce each other, thereby enhancing their strength against the shearing forces or bending moments acting thereon during extraction of the counterpart second connector II. Therefore, the housing 10 is firmly retained in place. Furthermore, since the attachment legs 62 of the reinforcing fittings 60 are typically fabricated with larger dimensions than those of the connecting legs 54 of the power supply terminals 50, the increase in strength is pronounced. Since a single common through-hole PT is sufficient, forming two through-holes in a spaced-apart relationship, as was the case in the past, is no longer needed, as a result of which no land-free zones are required between the through-holes and, therefore, the area necessary for land formation can be minimized.

Thus, the first connector I is mounted to the circuit board P and a mounting arrangement of the electrical connector for circuit boards is obtained.

As far as the second connector II is concerned, the connecting portions 81 of the upper signal terminals 80, connecting portions 91 of the lower signal terminals 90, connecting portions 101 of the upper power supply terminals 100, and connecting portions 111 of the lower power supply terminals 110 are solder-connected to the respectively corresponding circuits of the other circuit board, after which the mating protrusion 72 of the second connector II is mated with the receiving portion 11 of the first connector I and the second connector II is placed in electrical communication with the first connector I.

The present invention is not limited to the illustrated and described right-angle connectors and is also applicable to connectors of the type where the counterpart second connector is plugged and unplugged in a direction perpendicular to the mounting face of the circuit board, to which the first connector is mounted.

DESCRIPTION OF THE REFERENCE NUMERALS

10 Housing
20, 30 Signal terminals
40, 50 Power supply terminals (non-signal terminals)
54 Connecting leg
60 Reinforcing fitting
62 Attachment leg
P Circuit board
P3 Land (common land)
PT Through-hole
I Electrical connector for circuit boards (first connector)

The invention claimed is:

1. An electrical connector for circuit boards mounted to a circuit board, the electrical connector for circuit boards comprising:

a housing comprising an electrically insulating material, signal terminals and non-signal terminals used as at least one of ground terminals and power supply terminals, which are made of a metallic material and retained within said housing, and reinforcing fittings attached to the housing, wherein the non-signal terminals are located outside an array range of the signal terminals, the reinforcing fittings are located adjacent to said non-signal terminals, the non-signal terminals comprise connecting legs for connection to the circuit board, the reinforcing fittings comprise attachment legs for attachment to the circuit board, the connecting legs of the non-signal terminals and the attachment legs of the reinforcing fittings are located adjacent to each other in an array direction of the signal terminals within a single through-hole provided in a common land formed on a mounting face of the circuit board and extended around a periphery of the single through-hole and wherein the connecting legs and the attachment legs pass though the single through-hole and are solder-connected to said land on the mounting face;

wherein a through-thickness direction of the attachment legs of the reinforcing fittings intersects a direction of plugging and unplugging of the counterpart connector on the mounting face.

2. The electrical connector for circuit boards according to claim 1, wherein the housing is configured such that a receiving portion used for plugging and unplugging a counterpart connector is formed with its opening oriented such that the direction of plugging and unplugging of said counterpart connector is parallel to the mounting face of the circuit board.

3. The electrical connector for circuit boards according to claim 1, wherein the non-signal terminals and reinforcing fittings are made of sheet metal.

4. A mounting arrangement of an electrical connector for circuit boards, the electrical connector for circuit boards comprising:

a housing comprising an electrically insulating material, signal terminals and non-signal terminals used as at least one of ground terminals and power supply terminals, which are made of a metallic material and retained within said housing, and reinforcing fittings attached to the housing, wherein the non-signal terminals are located outside an array range of the signal terminals, the reinforcing fittings are located adjacent to said non-signal terminals, the non-signal terminals comprise connecting legs for connection to the circuit board, the reinforcing fittings comprise attachment legs for attachment to the circuit board, the connecting legs of the non-signal terminals and the attachment legs of the reinforcing fittings are located adjacent to each other in an array direction of the signal terminals within a single through-hole provided in a common land formed on a mounting face of the circuit board and extended around a periphery of the single-through-hole and wherein the connecting legs are solder-connected to said land on the mounting face, wherein the electrical connector for circuit boards is disposed on a circuit board and wherein the attachment legs of the reinforcing fittings and the connecting portions of the non-signal terminals of said electrical connector for circuit boards are located within the single through-hole in the circuit board and are solder-connected to a land on the perimeter edge of the through-hole on the mounting face, wherein a through-thickness direction of the attachment legs of the reinforcing fittings intersects a direction of plugging and unplugging of the counterpart connector on the mounting face.

* * * * *